US006868761B2

(12) United States Patent
Stoick et al.

(10) Patent No.: US 6,868,761 B2
(45) Date of Patent: Mar. 22, 2005

(54) BREAKAWAY TORQUE WRENCH

(75) Inventors: Michael Stoick, Prior Lake, MN (US); Carlos Cadavid, Chanhassen, MN (US)

(73) Assignee: Entegris, Inc., Chaska, MN (US)

( * ) Notice: Subject to any disclaimer, the term of this patent is extended or adjusted under 35 U.S.C. 154(b) by 0 days.

(21) Appl. No.: 10/706,621

(22) Filed: Nov. 12, 2003

(65) Prior Publication Data

US 2004/0144220 A1 Jul. 29, 2004

Related U.S. Application Data

(60) Provisional application No. 60/425,906, filed on Nov. 12, 2002.

(51) Int. Cl.[7] ..... B25B 23/14
(52) U.S. Cl. ..... 81/467; 81/120
(58) Field of Search ..... 81/467, 472, 120, 81/64, 177.1

(56) References Cited

U.S. PATENT DOCUMENTS

| | | | | |
|---|---|---|---|---|
| 3,425,314 A | * | 2/1969 | Ohlson | 411/7 |
| 3,512,447 A | | 5/1970 | Vaugn | |
| 3,847,038 A | | 11/1974 | Green | |
| 4,029,379 A | | 6/1977 | Kotala et al. | |
| 4,130,032 A | * | 12/1978 | Giandomenico et al. | 81/119 |
| 4,195,589 A | | 4/1980 | Blattner | |
| 4,290,329 A | | 9/1981 | Green | |
| D271,937 S | | 12/1983 | Combs | |
| 4,489,843 A | | 12/1984 | Drozd, Jr. | |
| 4,518,295 A | | 5/1985 | Matuschek | |
| D292,771 S | | 11/1987 | Kim | |
| 4,729,703 A | | 3/1988 | Sato | |
| 4,732,062 A | | 3/1988 | Grabovac et al. | |
| 4,789,759 A | | 12/1988 | Jones | |
| 4,898,068 A | | 2/1990 | Neuhaus | |
| 5,152,200 A | | 10/1992 | Kaplan | |
| 5,156,072 A | | 10/1992 | Muralidharan | |
| 5,178,424 A | | 1/1993 | Klinger | |
| 5,224,403 A | | 7/1993 | Rueb | |
| 5,297,458 A | | 3/1994 | Smith et al. | |
| 5,431,518 A | * | 7/1995 | Young et al. | 411/429 |
| D371,298 S | | 7/1996 | Reddy et al. | |
| 5,865,581 A | | 2/1999 | Sadri et al. | |
| 6,062,115 A | | 5/2000 | Bares et al. | |
| 6,079,298 A | | 6/2000 | Gasperi et al. | |
| 6,138,531 A | | 10/2000 | Lamons | |
| 6,176,659 B1 | | 1/2001 | Hardt et al. | |
| 6,295,901 B1 | * | 10/2001 | Mardirossian | 81/467 |
| 6,439,086 B1 | * | 8/2002 | Bahr | 81/467 |

FOREIGN PATENT DOCUMENTS

| | | |
|---|---|---|
| WO | WO 92/03262 | 3/1992 |

* cited by examiner

*Primary Examiner*—Debra S. Meislin
(74) *Attorney, Agent, or Firm*—Patterson, Thuente, Skaar & Christensen, P.A.

(57) ABSTRACT

The breakaway torque wrench generally includes a handle portion and an arcuate engagement portion. The arcuate engagement portion further includes at least one engagement tooth portion proximate one end of the arcuate engagement portion for secureable releasable engagement with an axial grooved fastener or object such as a pipe, nut, bolt, screw, and the like. The breakaway torque wrench is engageable and capable of disengagement at predefined torque levels without implementing complex and vulnerable mechanical designs of conventional practice.

23 Claims, 6 Drawing Sheets

BREAKAWAY TORQUE WRENCH

RELATED APPLICATIONS

This application claims the benefit of U.S. Provisional Patent Application Ser. No. 60/425,906 entitled "Breakaway Torque Wrench", filed Nov. 12, 2002, hereby fully incorporated herein by reference.

FIELD OF THE INVENTION

The present invention relates generally to hand tools and, more particularly, to torque wrenches for applying predetermined torque to engageable objects during operation.

BACKGROUND OF THE INVENTION

It is commonly understood that fasteners and like devices are utilized in mechanically connecting or coupling structures, devices and components. For many of these connections or couplings, it is important to the strength and safety of the connection to apply the proper degree of torque. If the torque is insufficient, the resulting connection may loosen over time and eventually fail to serve its intended function. If the amount of torque is too great, the fastener may be stripped and/or the connecting structures or objects may be damaged, each of which can result in structural or functional compromise.

Advances have been made in torque wrenches such that the amount of torque that can be communicated through the wrench to the connecting structures or fasteners is limited. There are a myriad of variations on these typical torque wrenches. For instance, breakaway wrenches have gained in popularity in recent years as manufacturers find that operator error while using dial or indicator wrenches increase in repetitive situations as attention to details tends to fall by the wayside and user discretion becomes highly variable. A conventional breakaway wrench addresses some of these problems by limiting the level of torque that can be applied. However, these conventional breakaway wrenches come with innate drawbacks that generally result from their complicated and intricate designs. Specifically, breakaway torque wrenches generally utilize spring actuated methods of measuring torque, wherein these springs are kept in a loaded condition throughout the life of the tool. This condition or loaded state inevitably shortens the operational lifetime of the wrenches since the spring mechanisms are subjected to a progressive degeneration. Component replacement and/or recalibrations are required to accommodate for this degeneration. Further, the intended functionality of the wrench during this period of degeneration is flawed such that the wrench is operating outside of its designed parameters, often without the user having any knowledge of the degeneration.

As a result, there is a need for a torque wrench that substantially solves the problems innately present with conventional torque wrenches. There is a need to provide for a breakaway torque wrench that functions to provide predefined breakaway or disengagement functionality during operation while still maintaining functional and structural reliability without requiring periodic recalibration or tool replacement.

SUMMARY OF THE INVENTION

The breakaway torque wrench of the present invention substantially solves the problems of conventional torque wrenches. The present invention generally includes a breakaway torque wrench comprising a handle portion and an arcuate engagement portion. The arcuate engagement portion further includes at least one engagement tooth portion, preferably proximate one end of the arcuate engagement portion for secureable releasable engagement with an axial grooved fastener or object such as a nut, bolt, screw, and the like. As such, the present invention provides a breakaway torque wrench that is engageable and capable of disengagement at predefined torque levels without implementing complex and vulnerable mechanical designs of conventional practice.

An advantage of the present invention is that the torque wrench is constructed to eliminate complicated and intricate components and component interactions.

Another advantage is that the torque wrench of the present invention is designed to operate extensively without need for reconfiguration or component replacement.

Yet another advantage of the present invention is that the relatively simplistic design and functionality allows for a relatively inexpensively manufactured product.

A further advantage is that the torque wrench of the present invention includes a handle to promote ease-of-use, and a handle aperture to permit employment of further devices to facilitate rotational operation of the wrench to an engaged object, such as a nut, bolt, screw, and the like.

Another advantage is that the engagement tooth portion of the present invention can employ various sizes and shapes to permit engagement with various axial grooved objects, and to allow for variable levels of breakaway engagement from said objects.

Still another advantage is the relative flexibility of the torque wrench of the present invention due to the preferred polymer construction, such as a fluoropolymer.

Yet another advantage is providing a breakaway torque wrench system wherein selective placement, sizing, shaping, and the employment of other configuration options to the arcuate engagement surface and the engagement tooth allow for selective torque levels and torque level ranges. As such, a plurality of wrenches with varying configurations and torque levels can be constructed to define a breakaway torque wrench kit.

DETAILED DESCRIPTION OF THE DRAWINGS

Figure 1:
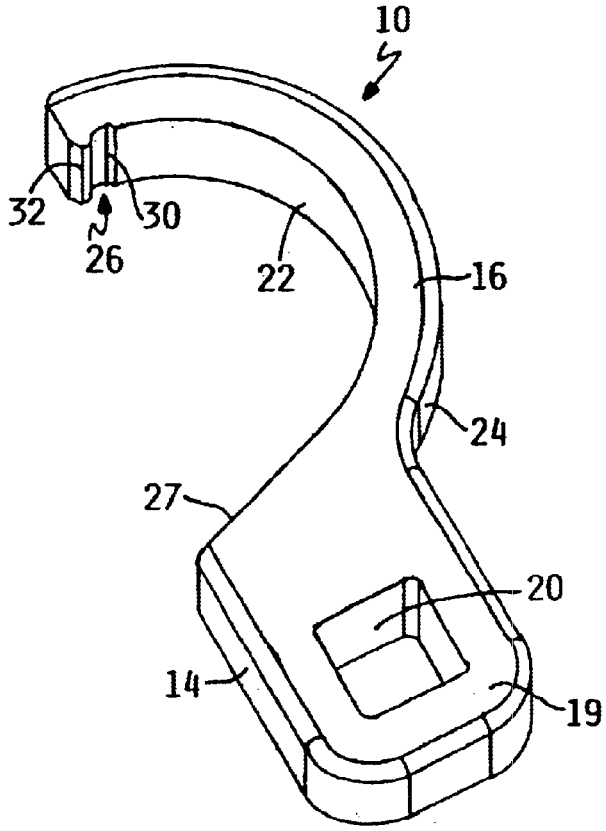
FIG. 1 shows a perspective view of an embodiment of the breakaway torque wrench of the present invention.

Referring to FIGS. 1–8, the breakaway torque wrench 10 of the present invention generally includes a handle portion 14 and an arcuate engagement portion 16 adapted to engage an axially grooved object 12 or fastener such as a pipe, tubing, screw, nut, bolt, and the like. The fastener 12 is preferably threaded to define a threaded member 12 to facilitate tightening and loosening during operation of the wrench 10. In one embodiment, the threaded member 12 includes internal threading, while other embodiments can include external male threading.

Preferably, the handle portion 14 and the arcuate engagement portion 16 are integral and of a plastic construction. Preferred embodiments will be constructed of fluoropolymers. A nearly endless array of manufacturing and formation techniques, and materials, can be employed without deviating from the spirit and scope of the present invention. For instance, polymers such as Acetal, Polyvinylidene Fluoride ("PVDF"), and Perfluoroalkoxy ("PFA") have been found to be desirable for specific embodiments of the present invention. Further, both machining and molding techniques known to one of ordinary skill in the art are envisioned for manufacturing and/or forming of the present invention.

In one embodiment, the handle portion 14 is substantially rectangular and includes a handle body portion 19 and a handle aperture 20 defined proximate the center of the body 19. The handle aperture 20 can be sized and shaped to facilitate receipt of a device to further enable rotational operation of the wrench 10 around the engaged object 12. Alternative embodiments of the handle portion 14 can include depressions for receiving a user's fingers, an elongated design, and a myriad of other configurations, shapes and designs to provide a mechanical and/or manual interface for rotationally actuating the torque wrench 10.

The arcuate engagement portion 16 of the present invention generally includes an inner arcuate engagement surface 22, an outer arcuate surface 24, and at least one engagement tooth portion 26. The arcuate engagement portion 16 is measurably malleable or compliant to provide a degree of flexibility needed to accommodate the outer surface of the respective engaged object 12 during engagement to and breakaway from the object 12. As such, various polymers and other materials capable of such accommodation are envisioned for use in constructing or molding the arcuate engagement portion 16 of the present invention, as described herein. The level of predefined torque for a particular embodiment of the present invention can be at least partially controlled by the flexibility and material construction of the arcuate engagement portion 16.

The arcuate engagement surface 22 is generally C-shaped, or hook shaped, and is capable of receiving a portion of the outer circumferential surface or diameter of the grooved object 12. The size and shape of the arcuate engagement surface 22 can vary depending upon the size, shape and design of the object 12. In one embodiment, the arcuate length is less than a complete circle. In another embodiment, the arcuate length of the arcuate engagement surface 22 can define a substantially oval shape. The arcuate engagement surface 22 includes the at least one engagement tooth portion 26, and an angled flex portion 27 distal the engagement tooth portion 26. Further, the arcuate engagement surface 22 can include one or more gripping portions to reduce slippage of the arcuate engagement surface 22 from the corresponding object 12 during engagement and operation. This gripping portion can include etchings, slots, ribs, dimples, nubs, grooves, and/or other alterations to the existing arcuate engagement surface 22, or the gripping portion can comprise an additional material selectively affixed to a portion of the arcuate engagement surface 22.

Figure 3:
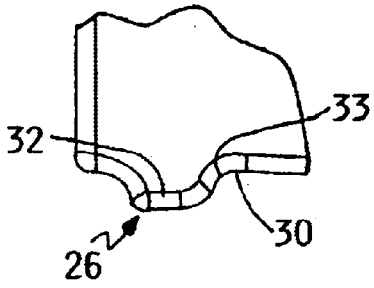
FIG. 3 shows a limited side section view of a protruding engagement tooth in accordance with an embodiment of the present invention.
Figure 2:
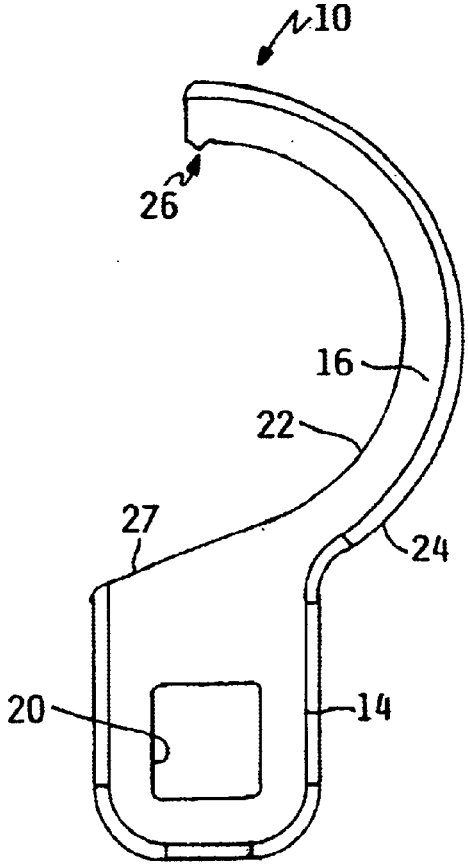
FIG. 2 shows a side view of the breakaway torque wrench of FIG. 1.
Figure 3A:
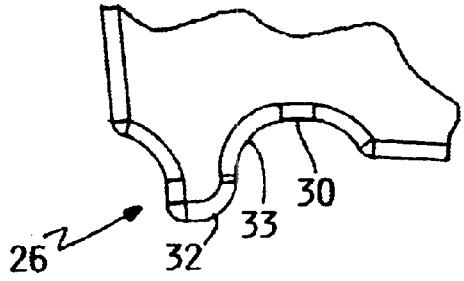
FIG. 3*a* shows a limited side section view of a protruding engagement tooth in accordance with an embodiment of the present invention.
Figure 3B:
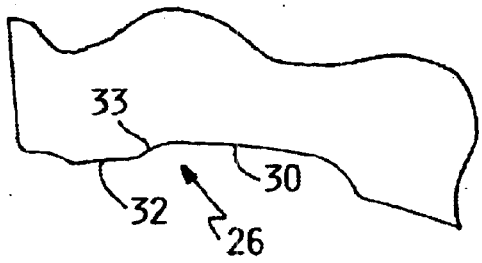
FIG. 3*b* shows a limited side section view of a protruding engagement tooth in accordance with an embodiment of the present invention.
Figure 3C:
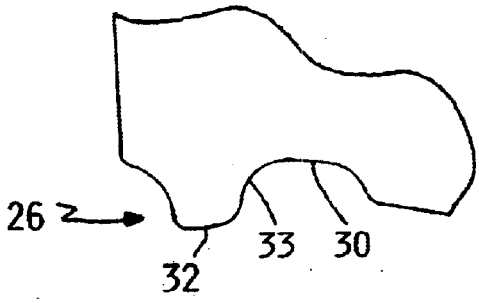
FIG. 3*c* shows a limited side section view of a protruding engagement tooth in accordance with an embodiment of the present invention.
Figure 4:
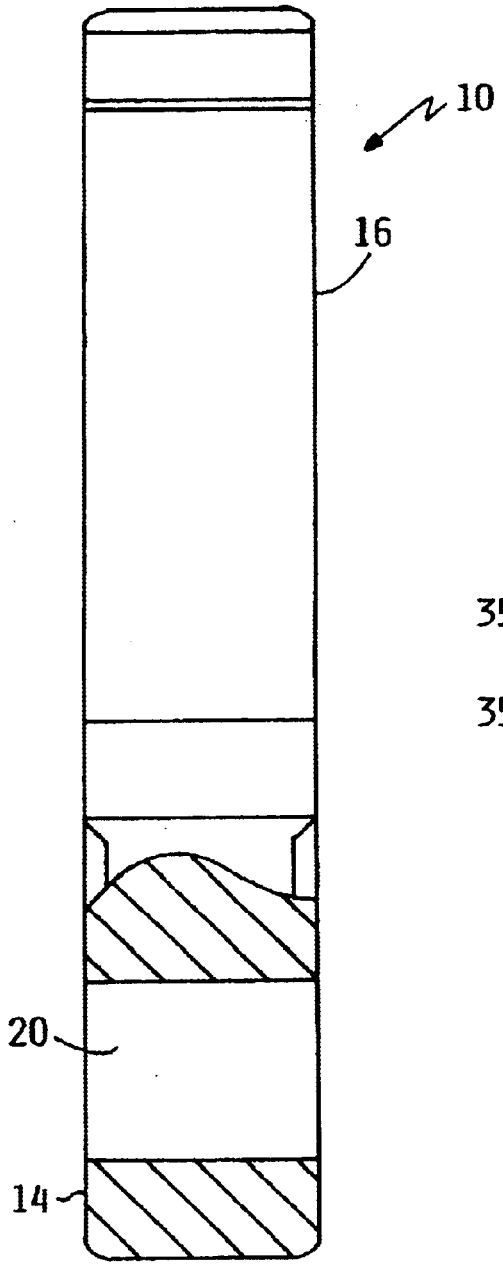
FIG. 4 shows a cross-section view of an embodiment of the breakaway torque wrench of the present invention.

The at least one engagement tooth portion 26 includes a tooth depression 30 and a tooth protrusion 32. The tooth depression 30 can further include a tooth angle surface 33 defining the surface connectivity between the tooth depression 30 and the tooth protrusion 32. The tooth angle 33 can vary greatly depending on the configuration, depth, and size of the groove(s) 35 of the object 12, and the breakaway threshold desired. For instance, rounded tooth angles, such as those shown in FIG. 3 will be required when the object 12 has corresponding rounded grooves 35. Other embodiments may include sharper, deeper, and/or longer tooth angle 33 surfaces. For instance, FIGS. 3–3*c* show various exemplary embodiments of the engagement tooth portion 26, each having different configurations for the tooth depression 30, the tooth protrusion 32, and the tooth angle surface 33. FIG. 3*a*, implements a longer or deeper tooth protrusion 32 combined with a relatively deep tooth depression 30 to facilitate engagement with an object or fastener 12 having relatively deep grooved portions 35. Conversely, FIG. 3*b* depicts a short tooth protrusion 32 combined with a relatively shallow but longer tooth depression 30 to facilitate engagement with a fastener 12 having spaced groove portions 35 of a shallow configuration. One skilled in the art will understand that a myriad of alternative size, shape, and positioning configurations for the engagement tooth portion 26 is possible without deviating from the spirit and scope of the present invention. Each of these and other configuration changes to the tooth portion 26 can be selectively implemented to result in a wrench 10 having a different torque level and/or torque level range.

In alternative embodiments, a plurality of engagement tooth portions 26 can be selectively spaced along the arcuate engagement surface 22. With such alternative embodiments, it is possible to implement a torque wrench 10 of the present invention that allows for various levels of torque breakaway and object 12 engagement. For instance, employment of more than one tooth portion 26 at predefined and desirable locations along the arcuate engagement surface 22 may be desirous for objects 12 or fasteners having distinct or unique groove 35 configurations.

Figure 6:
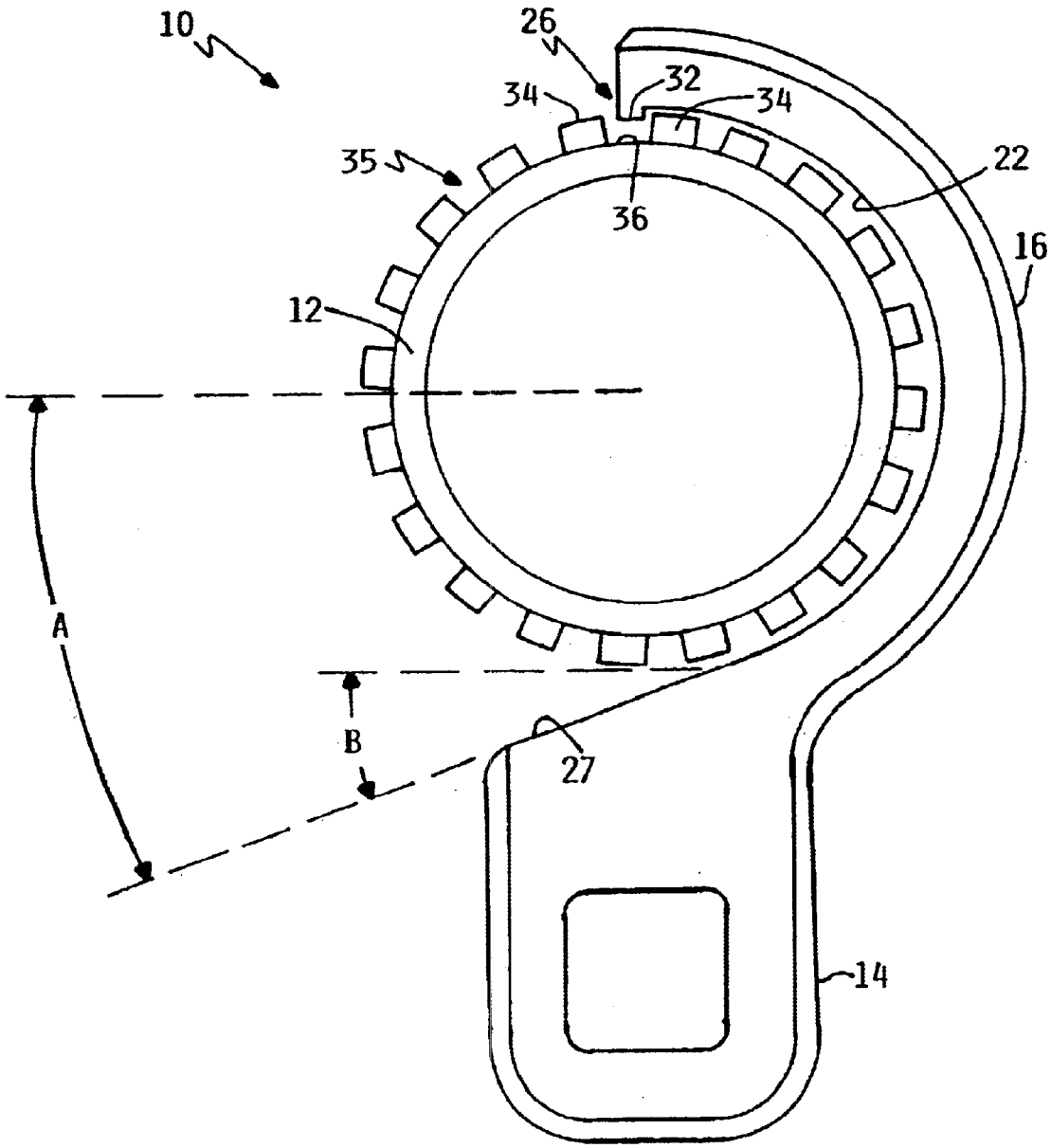
FIG. 6 is a side view of an embodiment of the present invention engaged with an axial grooved object or fastener.
Figure 7:
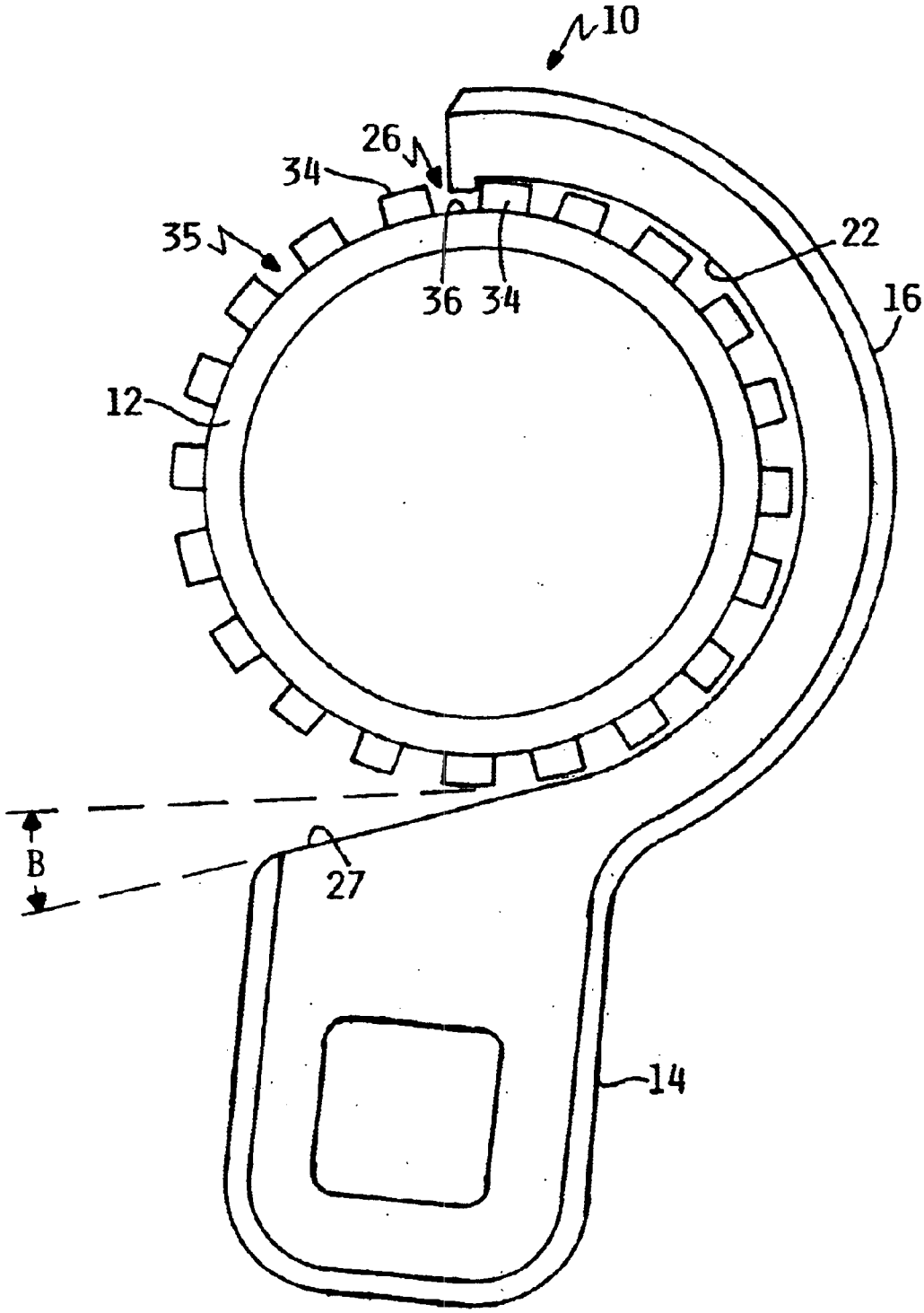
FIG. 7 is a side view of an embodiment of the present invention flexibly engaged with an axial grooved object or fastener.
Figure 8:
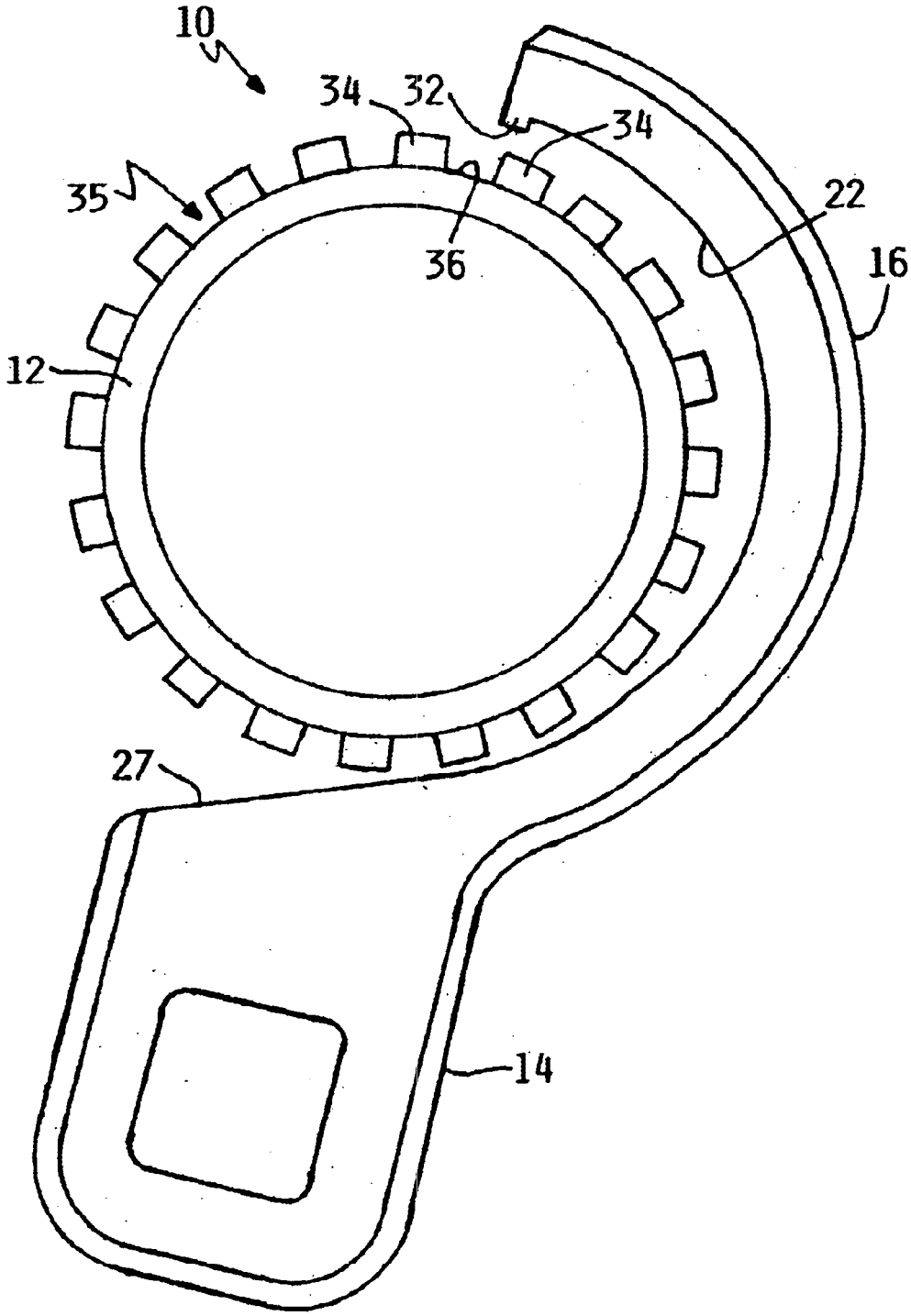
FIG. 8 is a side view of an embodiment of the present invention disengaging with an axial grooved object or fastener.

Referring primarily to FIGS. 6–8, the angled flex portion 27 is generally proximate the handle portion 14 and distal the tooth portion 26 and defines an angle A with respect to an engaged fastener 12. With at least one embodiment, angle A will generally equal 20°. Other angles are obviously envisioned. When engaged, the fastener 12 confrontingly secures along a substantial portion of the inner arcuate engagement surface 22. In this engagement position, the space between the outer surface of the fastener 12 and the angled flex portion 27 defines a flex gap B. As the torque level is increased during tightening of the fastener 12, the flex gap B is reduced, eventually causing the angled flex portion 27 to substantially contact a portion of the outer surface of the fastener 12. Further torque will ultimately result in disengagement of the tooth protrusion 32 from the fastener 12 groove 35, as shown in FIG. 8.

Figure 5:
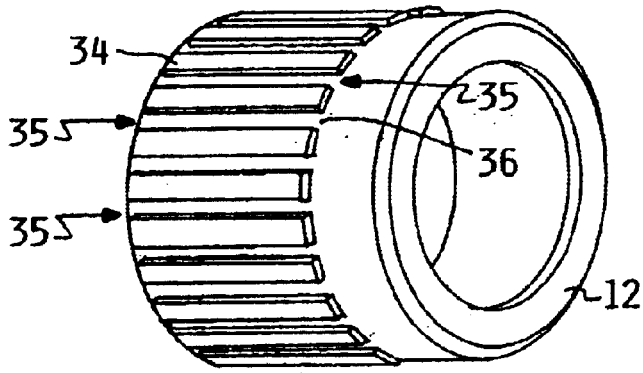
FIG. 5 is a perspective view of an axial grooved object/fastener capable of receiving an embodiment of the present invention.

Referring to FIGS. 5–6 primarily, the object or fastener 12 generally includes grooves 35 having land portions 34 and depressed notched portions 36. The land portions 34 of the object 12 will be received by and engage the tooth depression 30, and the notched portions 36 will be capable of receiving the tooth protrusion 32 to facilitate selective lockable engagement. Increasing or decreasing the level of engagement of the tooth depression 20, the tooth angle surface 33 and the protrusion 32 to the lands and notches of a standard, or predefined, object or fastener 12 allows for variable adjustment of the degree of torque required to initiate the desired disengagement or breakaway. In addition, placement of one of more of the engagement tooth portions 26 at various positions along the inner arcuate engagement surface 22 will vary or alter the level of predetermined torque for a particular embodiment of the present invention.

Various embodiments of the present invention will implement and employ the configuration and structural options described herein to define a breakaway torque wrench 10 having predetermined torque levels to control "jumping torque" of the wrench 10 from the fastener 12. These torque levels are often referred to in Inch-Pounds. Each of the embodiments can be constructed such that a minimum and maximum level of Inch-Pounds is defined to create a torque range. Preferably, disengagement of the tooth portion 26 from the grooves 35 of the fastener 12 will occur within this torque range. The minimum value is generally the level of torque that can initiate breakaway or disengagement of the arcuate engagement portion 16 from the fastener 12. The maximum value generally defines the highest acceptable torque value that can occur before disengagement is actuated, as any values greater than the maximum might undesirably cause thread crossing of the fastener 12.

For instance, the tooth portion 26 configurations exemplified in FIGS. 3*a*–3*c* can each define a unique predefined torque level. In one embodiment, the employment of the tooth configuration of FIG. 3*a* in a torque wrench 10 adapted to engage a ½" fastener 12 can result in a predefined torque level range of 38–40 Inch-Pounds. In another embodiment, the tooth configuration of FIG. 3*b* in a torque wrench 10 adapted to engage a ½" fastener 12 can result in a predefined torque level range of 13–14 Inch-Pounds. In still another embodiment, as shown in FIG. 3*c*, the tooth configuration combined with a wrench 10 adapted to engage a ¾" fastener 12 can result in a predefined torque level range of 22–23 Inch-Pounds. It will be understood to one skilled in the art that these embodiments are for illustrative purposes only and that one could alter the configuration and design of the present invention as described herein to create a nearly endless array of predefined torque level options.

Referring primarily to FIGS. 6–8, in operation, the user holds the breakaway torque wrench 10 by the handle 14 or by a separate handle interfaced with the handle 14 or handle aperture 20, selectively engageably securing the C-shaped inner arcuate engagement surface 22 around the outer surface of the fastener 12. Such engagement will align the at least one engagement tooth portion 26 with at least one of the axial grooves 35 of the fastener 12. Specifically, the tooth depression 30 receives the land portion 34 of the fastener 12, and the tooth protrusion 32 inserts within the notch portion 36 of the fastener 12. In this engagement position, the space between the outer surface of the fastener 12 and the angled flex portion 27 defines a flex gap B (FIG. 6). As the operator rotatably actuates the wrench 10, for example, in a clockwise direction, the torque level is increased, and the flex gap B is reduced (FIG. 7). Eventually this increase in torque and resulting flex will cause a portion of the angled flex portion 27 to substantially flex and initiate contact with a portion of the outer surface of the fastener 12. Flex at various portions of the engaged inner arcuate engagement surface 22 can also take place during operation. Moreover, flex toward the fastener 12 at one portion of the engagement surface 22 can cause another portion to flex away from the fastener 12. Further torque will ultimately result in deformation of the tooth protrusion 32 against the inner surface of the engaged groove 35 of the fastener 12, forcing disengagement of the tooth protrusion 32 from the fastener 12 groove 35 (FIG. 8). At the point of disengagement, the wrench 10 will freely spin around the fastener 12, signaling the operator that the proper amount of torque has been reached.

The present invention has been described above with reference to preferred embodiments. However, those skilled in the art will recognize that changes and modifications may be made to the preferred embodiments without departing from the spirit and scope of the present invention. Those skilled in the art will appreciate that the invention supports a wide range in material selection, dimensions, shapes, and the like. These and other changes and modification which are obvious to those skilled in the art are intended to be included with the present invention.

What is claimed is:

1. A breakaway torque wrench system, comprising:

a threaded member having a substantially circumferential outer surface and at least one axial groove defined in the circumferential outer surface;

a polymer breakaway torque wrench comprising;

a polymer arcuate engagement portion having an inner arcuate engagement surface, an angled flex portion, and at least one protrusion extending from the inner arcuate engagement surface, at least a portion of the inner arcuate engagement surface adapted to confrontingly engage a portion of the circumferential outer surface, and the at least one protrusion adapted to insertably engage within the at least one axial groove of the threaded member;

a handle operably connected to the angled flex portion of the arcuate engagement portion; and wherein rotational movement of the engaged breakaway torque wrench correspondingly rotates the threaded member such that the angled flex portion correspondingly approaches the threaded member until a predefined torque level is reached causing the at least one protrusion to disengage from the at least one axial groove.

2. The system of claim 1, wherein the arcuate engagement portion is generally C-shaped.

3. The system of claim 1, wherein the handle includes a handle aperture therethrough adapted to receive a handle device to facilitate rotational actuation of the breakaway torque wrench.

4. The system of claim 1, wherein at least the arcuate engagement portion is constructed of a thermopolymer.

5. The system of claim 4, wherein the thermopolymer is a fluoropolymer.

6. The system of claim 1, wherein the threaded member is a thermopolymer fastener.

7. The system of claim 6, wherein the thermopolymer fastener is selected from a group consisting of: a bolt, a screw, threaded tubing, and a nut.

8. The system of claim 1, wherein the threaded member includes internal threading.

9. The system of claim 1, wherein the threaded member includes external threading.

10. A method of operating a polymer breakaway torque wrench, comprising the steps of:

providing a polymer breakaway torque wrench including an arcuate engagement portion and a handle, the arcuate engagement portion having an inner arcuate engagement surface, at least one tooth protrusion extending therefrom, and an angled flex portion operably connected to the handle;

providing a polymer threaded fastening member having a substantially circumferential outer surface and at least one axial groove defined in the circumferential outer surface;

positionably engaging a portion of the inner arcuate engagement surface of the torque wrench around the circumferential outer surface of the threaded member such that the at least one tooth protrusion insertably engages the at least one axial groove of the object; and rotating the torque wrench about the longitudinal axis of the threaded member to correspondingly rotate the threaded member such that the angled flex portion correspondingly approaches the threaded member until a predetermined torque level is obtained causing the at least one tooth protrusion to forceably disengage from the at least one axial groove of the threaded member.

11. The method of claim 10, wherein rotating of the breakaway torque wrench about the longitudinal axis of the threaded member is facilitated by actuation of the handle of the breakaway torque wrench.

12. The method of claim 11, wherein the handle includes a handle aperture therethrough to facilitate rotation of the torque wrench.

13. A thermopolymer breakaway torque wrench comprising:

a thermopolymer handle;

a thermopolymer arcuate engagement portion operably attached to the handle and having a thermopolymer inner arcuate engagement surface;

at least one thermopolymer protrusion extending from the arcuate engagement surface adapted to inser tably engage a threaded member having at least one axial groove defined therein such that the at least one protrusion insertably engages the at least one axial groove;

an angled flex portion extending to the handle; and wherein rotational movement of the engaged breakaway torque wrench correspondingly rotates the threaded member such that the angled flex portion correspondingly approaches the threaded member until a predefined torque level is reached and the at least one protrusion disengages from the at least one axial groove.

14. The thermopolymer breakaway torque wrench of claim 13, wherein the handle includes a handle aperture therethrough adapted to receive a handle device to facilitate rotational actuation of the breakaway torque wrench.

15. The thermopolymer breakaway torque wrench of claim 13, wherein at least the thermopolymer arcuate engagement portion is constructed of a fluoropolymer.

16. The thermopolymer breakaway torque wrench of claim 13, wherein the thermopolymer breakaway torque wrench is constructed of a fluoropolymer.

17. The thermopolymer breakaway torque wrench of claim 13, wherein the arcuate engagement portion is generally C-shaped.

18. A fluoropolymer breakaway torque wrench system comprising:

means for handling the breakaway torque wrench;

fluoropolymer arcuate engagement means operably attached to the handle portion for engaging a threaded member having axial grooves defined therein, the arcuate engagement means having a fluoropolymer inner arcuate engagement surface;

at least one fluoropolymer protruding means extending from the arcuate engagement surface for insertably engaging at least one of the axial grooves of the threaded member; and angled means operably connected to the means for handling, for providing operating flex such that the angled means correspondingly approaches the threaded member upon rotational actuation of the engaged threaded member until a predefined torque level is reached and the at least one protruding means disengages from the at least one axial groove of the threaded member.

19. The fluoropolymer breakaway torque wrench system of claim 18, wherein the means for handling includes a handle aperture therethrough adapted to receive a handle device to facilitate rotational actuation of the breakaway torque wrench.

20. The fluoropolymer breakaway torque wrench system of claim 18, wherein the arcuate engagement means is generally C-shaped.

21. The fluoropolymer breakaway torque wrench system of claim 18, wherein the threaded member is selected from a group consisting of: a bolt, a screw, threaded tubing, and a nut.

22. The fluoropolymer breakaway torque wrench system of claim 18, wherein the threaded member includes internal threading.

23. The fluoropolymer breakaway torque wrench system of claim 18, wherein the threaded member includes external threading.

* * * * *